US009164474B2

(12) United States Patent
Tampier

(10) Patent No.: US 9,164,474 B2
(45) Date of Patent: Oct. 20, 2015

(54) TONER DRUM GEAR PROJECTION

(71) Applicant: Clover Technologies Group, LLC, Ottawa, IL (US)

(72) Inventor: Francisco Tampier, San Lorenzo, CA (US)

(73) Assignee: CLOVER TECHNOLOGIES GROUP, LLC, Ottawa, IL (US)

( * ) Notice: Subject to any disclaimer, the term of this patent is extended or adjusted under 35 U.S.C. 154(b) by 0 days.

(21) Appl. No.: 14/150,105

(22) Filed: Jan. 8, 2014

(65) Prior Publication Data

US 2014/0190300 A1 Jul. 10, 2014

Related U.S. Application Data

(60) Provisional application No. 61/750,119, filed on Jan. 8, 2013.

(51) Int. Cl.

| | |
|---|---|
| ***G03G 15/02*** | (2006.01) |
| ***G03G 15/00*** | (2006.01) |
| ***G03G 21/16*** | (2006.01) |
| ***G03G 15/08*** | (2006.01) |
| *G03G 21/18* | (2006.01) |

(52) U.S. Cl.

CPC ..... *G03G 21/1647* (2013.01); *G03G 15/0865* (2013.01); *G03G 15/757* (2013.01); *G03G 21/1857* (2013.01); *G03G 2221/1657* (2013.01); *Y10T 74/19851* (2015.01)

(58) Field of Classification Search

CPC ..... G03G 15/757; G03G 21/1857; G03G 21/1647; G03G 2221/1657

USPC ..... 399/116, 117, 167

See application file for complete search history.

(56) References Cited

U.S. PATENT DOCUMENTS

| | | | | |
|---|---|---|---|---|
| 5,247,325 | A | 9/1993 | Takahashi | |
| 5,903,803 | A | 5/1999 | Kawai et al. | |
| 5,926,673 | A | 7/1999 | Foster et al. | |
| 5,987,287 | A | 11/1999 | Huang | |
| 6,128,454 | A | 10/2000 | Kawai et al. | |
| 6,173,146 | B1 * | 1/2001 | Wang et al. | 399/265 |
| 6,226,478 | B1 | 5/2001 | Watanabe et al. | |
| 6,240,266 | B1 | 5/2001 | Watanabe et al. | |
| 6,336,018 | B1 * | 1/2002 | Kawai et al. | 399/117 |
| 6,349,188 | B1 | 2/2002 | Kawai et al. | |
| 6,501,926 | B1 | 12/2002 | Watanabe et al. | |
| 6,501,927 | B1 | 12/2002 | Watanabe et al. | |
| 6,885,838 | B2 | 4/2005 | Kawai et al. | |
| 6,892,042 | B2 * | 5/2005 | Jang et al. | 399/167 |
| 6,999,696 | B2 | 2/2006 | Noda et al. | |
| 7,092,655 | B2 | 8/2006 | Noda et al. | |
| 7,231,161 | B2 | 6/2007 | Noda et al. | |
| 7,236,722 | B2 | 6/2007 | Portig | |
| 7,248,814 | B2 | 7/2007 | Kawai et al. | |
| 7,274,896 | B2 | 9/2007 | Kawai et al. | |

(Continued)

*Primary Examiner* — David Gray
*Assistant Examiner* — Tyler Hardman
(74) *Attorney, Agent, or Firm* — Mathew G. Gavronski

(57) ABSTRACT

A toner drum drive assembly is configured to engage a drive mechanism of a printer. The assembly includes a support portion defining an axis, and a drive projection extending axially from the support portion. The drive projection includes three radially outwardly and circumferentially extending arm portions, with each arm portion having an end. The drive projection defines three undercuts, and each undercut is positioned axially between the support portion and a respective arm portion end.

12 Claims, 3 Drawing Sheets

(56) References Cited

U.S. PATENT DOCUMENTS

| | | | | |
|---|---|---|---|---|
| 7,403,733 | B2 | 7/2008 | Watanabe et al. | |
| 7,489,885 | B2 | 2/2009 | Noda et al. | |
| 7,630,661 | B2 | 12/2009 | Noda et al. | |
| 7,660,545 | B2 | 2/2010 | Noda et al. | |
| 7,813,676 | B2 * | 10/2010 | Huck et al. | 399/167 |
| 7,920,806 | B2 | 4/2011 | Noda et al. | |
| 8,073,364 | B2 | 12/2011 | Huck et al. | |
| D667,049 | S * | 9/2012 | Park et al. | D18/43 |
| D678,398 | S | 3/2013 | Huck et al. | |
| 8,628,269 | B2 * | 1/2014 | Fan | 403/383 |
| 8,634,747 | B2 | 1/2014 | Huck et al. | |
| D698,861 | S * | 2/2014 | Huang et al. | D18/43 |
| 8,886,087 | B2 * | 11/2014 | Wu et al. | 399/117 |
| 2009/0279917 | A1 * | 11/2009 | Tsui et al. | 399/111 |
| 2010/0196047 | A1 * | 8/2010 | Jin | 399/111 |
| 2010/0303501 | A1 * | 12/2010 | Tsui | 399/167 |
| 2011/0211863 | A1 | 9/2011 | Watanabe et al. | |
| 2012/0045247 | A1 * | 2/2012 | Lewis | 399/167 |
| 2012/0257906 | A1 * | 10/2012 | Zhao | 399/111 |
| 2014/0069220 | A1 * | 3/2014 | Morgan | 74/434 |
| 2014/0133886 | A1 * | 5/2014 | Kurokawa et al. | 399/167 |

* cited by examiner

TONER DRUM GEAR PROJECTION

CROSS-REFERENCE TO RELATED APPLICATION

This application claims the benefit of and priority to U.S. Provisional Patent Application No. 61/750,119, filed Jan. 8, 2013, the entire contents of which are hereby incorporated by reference herein.

BACKGROUND

When a toner cartridge for a laser printer is installed in a printer, a variety of mechanical and electrical connections can be made between the toner cartridge and the printer. These connections may include a driving mechanical connection between a drive gear on the printer and a driven gear provided on one end of a toner drum in the toner cartridge. Different makes and models of printers can include mechanical and electrical connections in different configurations. For example, one line of printers utilizes a toner drum gear having a twisted, substantially triangular hole formed therein. For proper operation of aftermarket or replacement toner cartridges in that line of printers, the toner drum of the replacement toner cartridge should include a projection that is able to receive driving rotatable force from the twisted triangular hole provided in the toner drum drive gear of the printer.

SUMMARY

In some aspects, a toner drum drive assembly includes a support portion defining an axis, and a drive projection extending axially from the support portion. The drive projection includes three radially outwardly and circumferentially extending arm portions. Each arm portion has an end. The drive projection defines three undercuts, and each undercut is positioned axially between the support portion and a respective arm portion end.

The support portion may include an end face, and the undercut may be positioned between the end face and the respective arm portion end.

The drive projection may include three first sides and three second sides arranged about the axis in an alternating manner. The first sides and the second sides may be substantially planar and parallel to the axis. Each first side may reside in a respective first side plane, and the first side planes may define a first equilateral triangle when viewed along the axis. Each second side may reside in a respective second side plane, and the second side planes may define a second equilateral triangle when viewed along the axis. The second equilateral triangle may be rotated about the axis relative to the first equilateral triangle. The first and second sides may be joined by three acute-angle corners and three obtuse-angle corners alternatingly spaced around the drive projection. The drive projection may include chamfers between adjacent first and second sides. The chamfers may be formed along a portion of each acute-angle corner and may define the undercuts.

The drive projection may include three convex sidewalls and three concave wall portions. Each concave wall portion may extend substantially radially outwardly away from the axis and may join a respective upright face. Each upright face may be substantially flat. Each upright face may extend between its respective concave wall portion and a respective adjacent one of the convex sidewalls. The drive projection may include three angle chamfers. Each angle chamfer may extend from a distal end of a respective concave wall portion to a respective adjacent one of the convex sidewalls. Each angle chamfer may define a respective one of the undercuts. Each convex sidewall may include a proximal end proximal to the axis and a distal end distal from the axis, and each concave wall portion may be positioned adjacent the proximal end of a respective one of the convex sidewalls. Each concave wall portion may provide a geometric transition between a generally circumferentially directed trajectory of the proximal end of its respective convex sidewall and a generally radially outwardly directed trajectory.

The projection may include three generally semi-circular projecting members, and each projecting member may extend between a respective concave wall portion and the distal end of an adjacent one of the sidewalls. The projecting members may define convex end portions of each arm portion. Each undercut may extend between the distal end of a respective sidewall and a respective concave wall portion, and may be positioned below a respective one of the projecting members.

In other aspects, a toner drum drive assembly includes a support portion defining an axis, a drive projection extending axially from the support portion. The drive projection includes three convex sidewalls each having a proximal end proximal to the axis and a distal end distal from the axis. The drive projection also includes three concave wall portions, each concave wall portion being adjacent to the proximal end of a respective one of the convex sidewalls. The drive projection further includes three generally semi-circular projecting members, each projecting member extending between a respective concave wall portion and the distal end of a respective sidewall. The drive projection still further includes three undercuts, with each undercut positioned below a respective projecting member.

Each undercut may extend between the concave wall portion and the distal end of the sidewall associated with the respective projecting member. The convex sidewalls may have a larger radius than a radius of the concave wall portions. Each projecting member and its respective concave wall portion and respective convex sidewall may cooperate to define a radially outwardly and circumferentially extending arm portion. Each projecting member may define a convex end portion of a respective arm portion. Each concave wall portion may provide a geometric transition between a generally circumferentially directed trajectory of the proximal end of a respective sidewall to a generally radially outwardly directed trajectory. The projecting members may be generally semi-circular when viewed along the axis.

DETAILED DESCRIPTION

Figure 1:
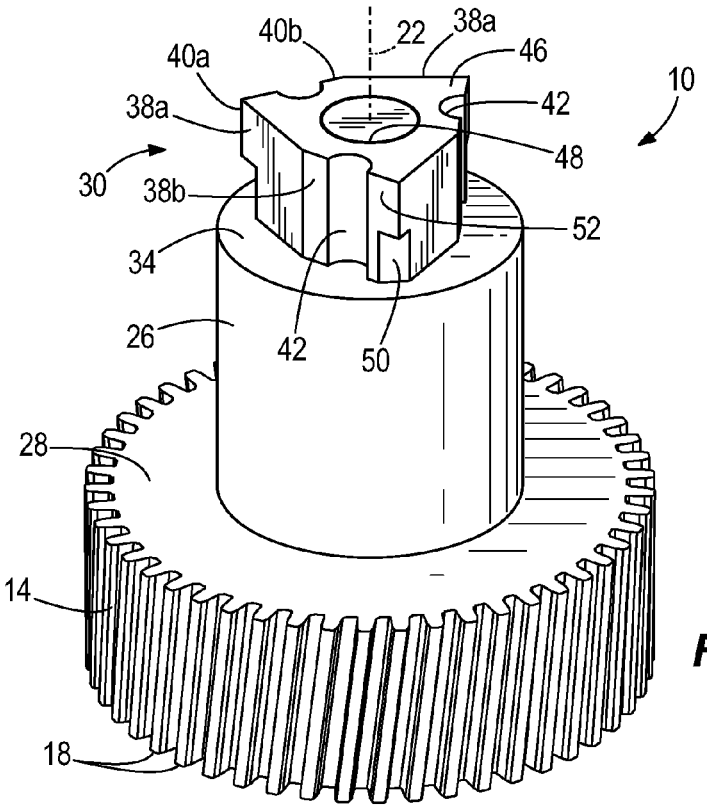
FIG. 1 is a perspective view of a first embodiment of a toner drum gear.

While the subject matter of this disclosure can be practiced and carried out in many different ways, certain specific embodiments are shown in the drawings and described in detail with the understanding that such drawings and description are exemplary in nature and are not intended to limit the scope of the invention set forth in claims only to those embodiments that are illustrated and described.

Figure 2:
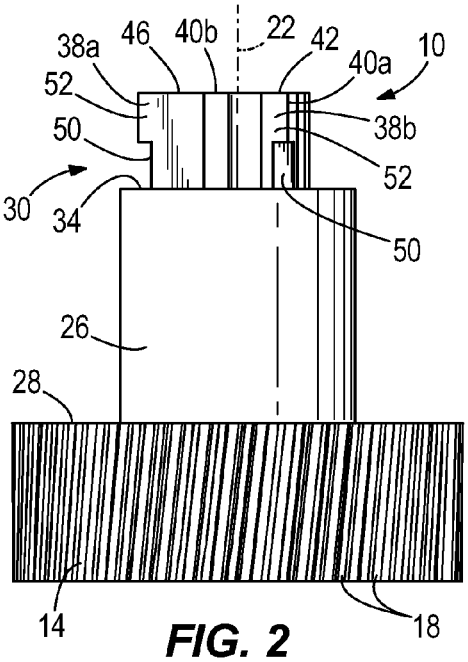
FIG. 2 is a side view of the toner drum gear of FIG. 1.
Figure 3:
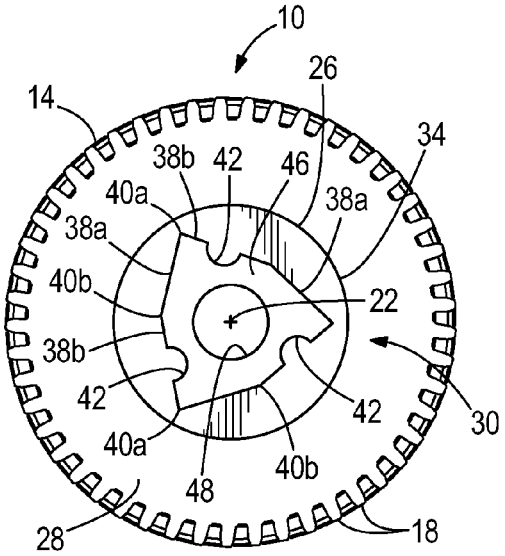
FIG. 3 is an end view of the toner drum gear of FIG. 1.

FIGS. 1-3 illustrate a toner drum gear 10 for attachment to or forming with a toner drum (not shown) in a toner cartridge for a laser printer. In the illustrated embodiment, the drum gear 10 includes a cylindrical projection 12 configured to fit within an end opening provided in the toner drum. The drum gear 10 is configured to receive driving rotatable force from a twisted triangular hole provided in the drive gear of a printer, such as that disclosed in U.S. Pat. No. 6,035,159. As such, the drum gear 10 is configured for substantial alignment with the longitudinal axis of the toner drum to which it is attached.

In the illustrated embodiment, the drum gear 10 includes a gear portion 14 having gear teeth 18 formed thereon. The gear portion 14 is substantially cylindrical and defines a central axis 22 of the drum gear 10. The gear portion 14 is coupled to and substantially coaxially aligned with the cylindrical projection 12. Those skilled in the art will appreciate that a variety of gear configurations may be used, including helical gear teeth, as shown, straight gear teeth, herringbone gear teeth, and the like. In some embodiments, the gear portion 14 may be eliminated entirely.

A generally cylindrical support base 26 extends axially from an end face 28 of the gear portion 14. In the illustrated embodiment the support base 26 has an outer diameter that is less than the outer diameters of the gear portion 14. The support base 26 is substantially axially aligned with the gear portion 14.

A drivable drive projection 30 extends axially from an end face 34 of the support base 26, and is configured to fit within a hole in a printer drive, such as a twisted triangular hole provided in the drive gear of the printer into which the associated toner cartridge is to be installed. The drive projection 30 is in the form of an upright prism and, as shown in FIG. 3, includes a first set of three first sides 38*a* and a second set of three second sides 38*b*, with the sides spaced around the axis 22 in an alternating manner. The first and second sides 38*a*, 38*b* are joined by three acute-angle corners 40*a* and three obtuse-angle corners 40*b* alternatingly spaced around the drive projection 30.

The first sides 38*a* are substantially planar and parallel to the axis 22. The second sides 38*b* are also substantially planar and parallel to the axis 22, but also include an axially extending groove 42 having a substantially semi-circular cross-section. In the illustrated configuration, the grooves 42 extend from the end face 34 of the support base 26 to an end face 46 of the drive projection 30. When viewed along the axis 22 as in FIG. 3, each groove 42 is substantially centered along its respective second side 38*b*. Each first side 38*a* resides in a respective plane, and when the planes associated with each first side 38*a* are viewed along the axis 22 (as in FIG. 3), the planes define a first equilateral triangle. Each second side also resides in a plane, and when the planes associated with each second side 38*b* are viewed along the axis (as in FIG. 3), the planes define a second equilateral triangle that is rotated about the axis 22 with respect to the first equilateral triangle. In some embodiments, the end face 46 of the drive projection 30 may include an axially extending opening 48, such as the illustrated circular opening 48. In some embodiments, the opening 48 may accommodate an electrical contact (not shown) that is electrically connectable with the printer when the cartridge including the drum gear 10 is installed in the printer.

As shown in FIGS. 1 and 2, the drive projection 30 also includes chamfers between adjacent first and second sides 38*a*, 38*b* that define undercuts 50 formed along a portion of each acute-angle corner 40*a*. The illustrated undercuts 50 extend from the end face 34 of the support base 26 to a location between the end face 34 of the support base 26 and the end face 46 of the drive projection 30. In the exemplary embodiment shown in the drawings, the undercuts extend to a location approximately half-way between the end face 34 and the end face 46. Thus, in the configuration shown in FIGS. 1 and 2, the portions of the first sides 38*a*, second sides 38*b*, and acute-angle corners 40*a* positioned axially between the undercuts 50 and the end face 46 of the drive projection define radially outwardly and circumferentially extending arm portions 52 that function to engage the drive mechanism of the printer. Provision of the undercuts 50 may improve engagement of the arm portions 52 with the drive mechanism of the printer, depending in part upon the specific configuration of the drive mechanism.

Figure 4:
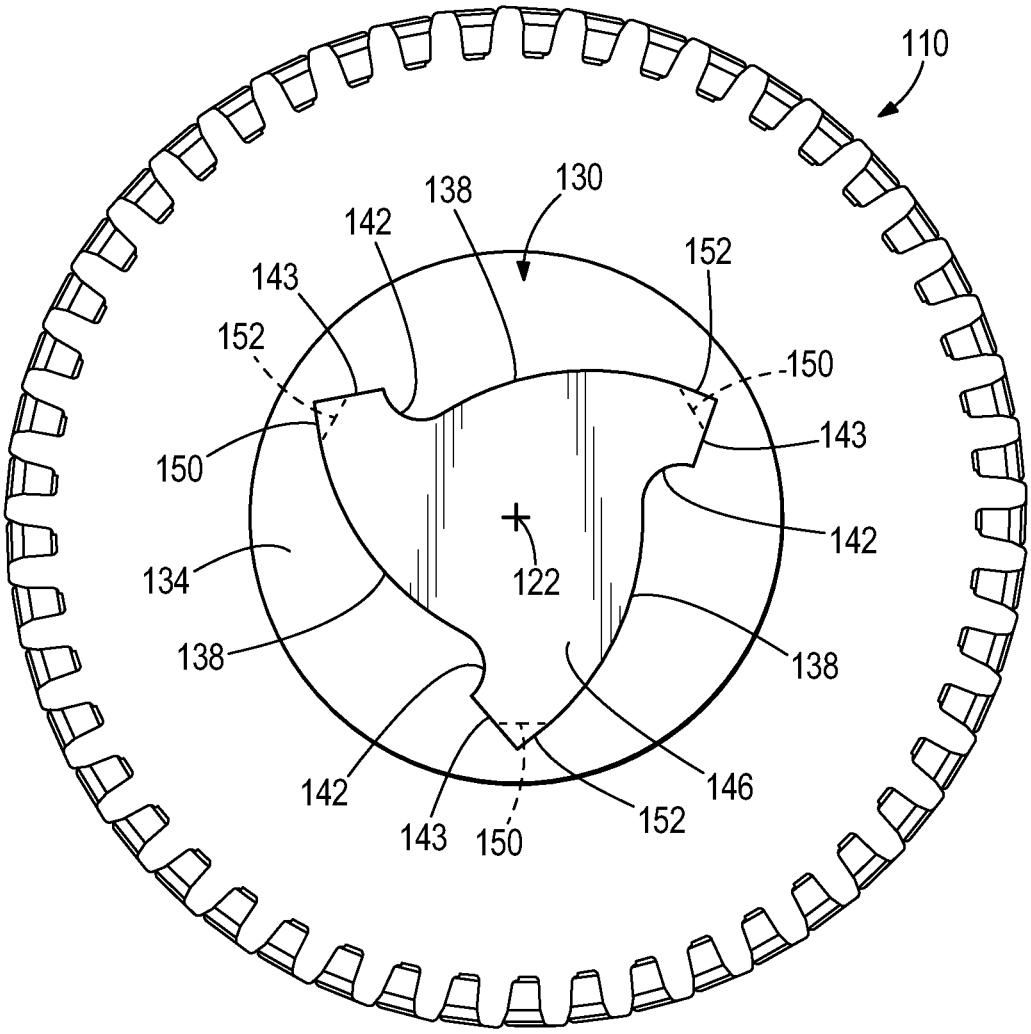
FIG. 4 is an end view of a second embodiment of a toner drum gear.

Referring to FIG. 4, a second embodiment of a toner drum gear 110 is shown, where features similar to those of the first embodiment have been given like reference numerals increased by one-hundred. The toner drum gear 110 includes a drive projection 130 similar to that shown in FIGS. 1-3, but instead of having three pairs of sides 38*a*, 38*b* like the projection 30, the drive projection 130 includes three smoothly curved and convex sidewalls 138, each having a relatively large radius. Each sidewall 138 blends into a respective concave wall portion 142 that substantially corresponds with the grooves 42 of the embodiment of FIGS. 1-3. Each concave wall portion 142 extends substantially radially outwardly away from the axis 122 and joins a substantially flat upright face 143. The upright face 143 extends between the concave wall portion 142 and an adjacent one of the convex sidewalls 138. An angle chamfer defines an undercut 150 (shown in broken lines in FIG. 4) positioned below the upright face 143. The undercut 150 extends from the end face 134 of the support base 126 to a location between the end face 134 of the support base 126 and the end face 146 of the drive projection 130. For example, in some embodiments the undercut 150 extends to a location substantially mid-way between the end face 134 and the end face 146, similar to the embodiment of FIGS. 1-3. Thus, in the configuration shown in FIG. 4, the end faces 134 and the radially-outermost portions of each respective sidewall 138 cooperate to define respective radially outwardly and circumferentially extending arm portions 152 that function to engage the drive mechanism of the printer. The arm portions 152 are located axially between the undercuts 150 and the end face 146 of the drive projection 130.

Figure 5:
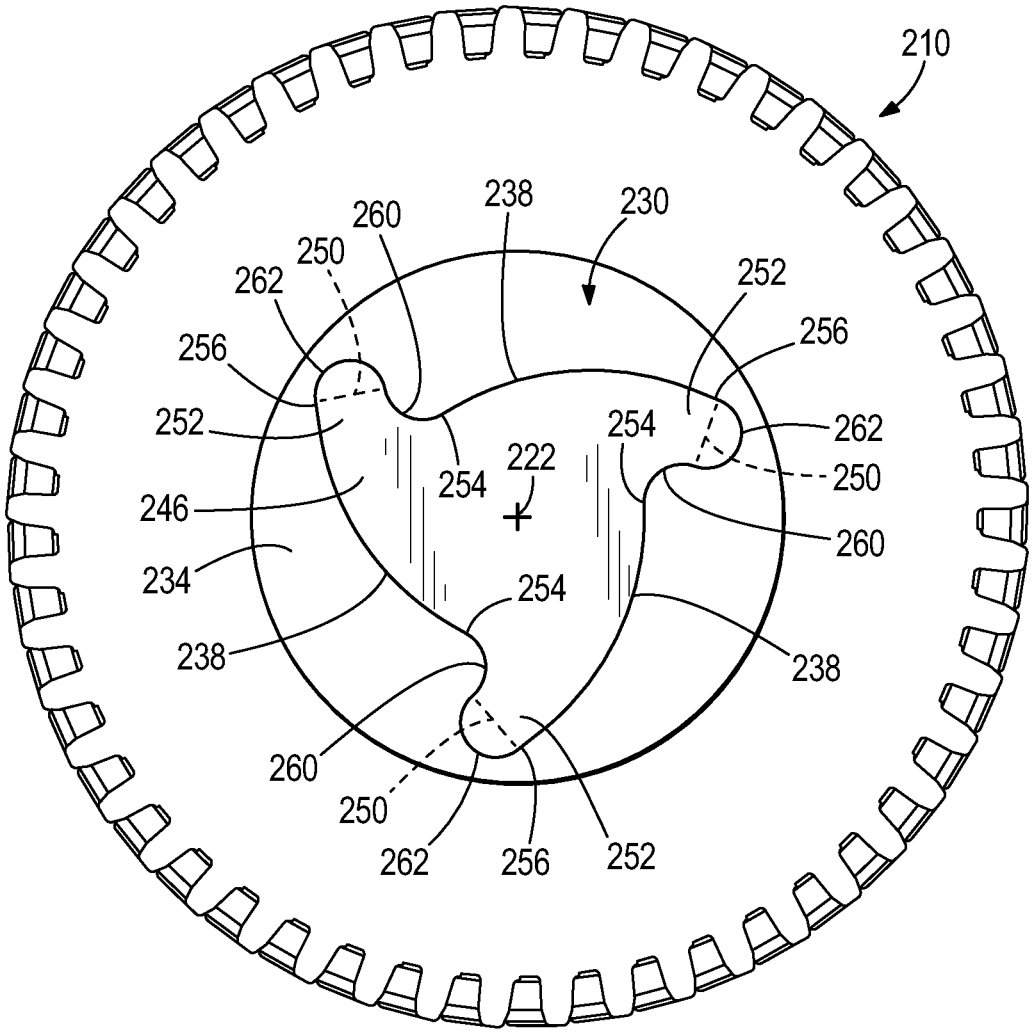
FIG. 5 is an end view of a third embodiment of a toner drum gear.

Referring to FIG. 5, a third embodiment of a toner drum gear 210 is shown, where features similar to those of the first embodiment have been given like reference numerals increased by two-hundred. The toner drum gear 210 includes a drive projection 230 having a generally pinwheel-like shape. The illustrated drive projection 230 includes a plurality (e.g., three, as shown) of arm portions 252 defined in part by three convex sidewalls 238 having a relatively large radius that extend upwardly from the end face 234 of the support base 226. Each sidewall 238 includes a proximal end 254 proximal to the axis 222 and a distal end 256 distal from the axis 222. Adjacent the proximal end 254 of each sidewall 238 is a concave wall portion 260 having a relatively small radius. When viewed along the axis 222, the concave wall portion provides a geometric transition between the generally circumferentially directed trajectory of the proximal end 254 of the sidewall 238 to a generally radially outwardly directed trajectory.

The projection 230 also includes three generally semi-circular projecting members 262 that extend between the concave wall portions 260 and the distal ends 256 of the sidewalls 238. In this regard, the projecting members 262 define convex end portions of each arm portion 252. Like the embodiment of FIGS. 1-3, the projection 230 also includes undercuts 250 (shown in broken lines in FIG. 5) in the form of substantially flat surfaces that extend between the concave wall portion 260 and the distal end 256 of the respective sidewall 238. The undercuts 250 are positioned below the projecting members 262 and extend from the end face 234 of the support base 226 to a location between the end face 234 of the support base 226 and the end face 246 of the drive projection 230. The undercuts 250 may improve engagement of the projecting members 262 with the drive mechanism of the printer, depending in part upon the specific configuration of the drive mechanism.

While specific embodiments have been illustrated and described, numerous modifications come to mind without significantly departing from the spirit of the disclosure, and the scope of protection is to be limited only by the scope of the accompanying claims.

What is claimed is:

1. A toner drum drive assembly comprising:

a support portion defining an axis and including an end face; and a drive projection extending axially from the support portion and defining an end surface, the drive projection including three radially outwardly and circumferentially extending arm portions, each arm portion having an end, and the drive projection defining three undercuts, each undercut positioned axially between the support portion and a respective arm portion end, wherein the drive projection includes three substantially planar first sides and three substantially planar second sides extending parallel to the axis and arranged about the axis in an alternating manner, wherein each second side includes a generally radially outwardly opening groove having a substantially semicircular cross-section and extending axially from the end face of the support portion to the end surface of the drive projection, wherein each first side resides in a respective first side plane, and wherein the first side planes define a first equilateral triangle when viewed along the axis, and wherein each second side resides in a respective second side plane, wherein the second side planes define a second equilateral triangle when viewed along the axis, and wherein the second equilateral triangle is rotated about the axis relative to the first equilateral triangle.

2. The toner drum drive assembly of claim 1, wherein the undercut is positioned between the end face and the respective arm portion end.

3. The toner drum drive assembly of claim 1, wherein the first and second sides are joined by three acute-angle corners and three obtuse-angle corners alternatingly spaced around the drive projection.

4. The toner drum drive assembly of claim 3, wherein the drive projection includes chamfers between adjacent first and second sides, wherein the chamfers are formed along a portion of each acute-angle corner and define the undercuts.

5. A toner drum drive assembly comprising:

a support portion defining an axis; and a drive projection extending axially from the support portion, the drive projection including three radially outwardly and circumferentially curved arm portions arranged in a generally pinwheel-like shape, each arm portion having an end, and the drive projection defining three undercuts, each undercut positioned axially between the support portion and a respective arm portion end, wherein the drive projection includes three convex sidewalls and three concave wall portions, wherein each concave wall portion extends substantially radially outwardly away from the axis and joins a respective substantially flat upright face, wherein each upright face defines the end of a respective one of the arm portions, wherein each upright face extends between its respective concave wall portion and a respective adjacent one of the convex sidewalls, and wherein the drive projection includes three angle chamfers, each angle chamfer extending from a distal end of a respective concave wall portion to a respective adjacent one of the convex sidewalls.

6. The toner drum drive assembly of claim 5, wherein each angle chamfer defines a respective one of the undercuts.

7. The toner drum drive assembly of claim 5, wherein each convex sidewall includes a proximal end proximal to the axis and a distal end distal from the axis, and wherein each concave wall portion is positioned adjacent the proximal end of a respective one of the convex sidewalls.

8. The toner drum drive assembly of claim 7, wherein each concave wall portion provides a geometric transition between a generally circumferentially directed trajectory of the proximal end of its respective convex sidewall and a generally radially outwardly directed trajectory.

9. A toner drum drive assembly comprising:

a support portion defining an axis and including an end face; and a drive projection extending axially from the support portion and defining an end surface, the drive projection including three radially outwardly and circumferentially extending arm portions, each arm portion having an end, and the drive projection defining three undercuts, each undercut positioned axially between the support portion and a respective arm portion end, wherein the drive projection includes three substantially planar first sides and three substantially planar second sides extending parallel to the axis and arranged about the axis in an alternating manner, wherein each second side includes a generally radially outwardly opening groove having a substantially semicircular cross-section and extending axially from the end face of the support portion to the end surface of the drive projection, and wherein the first and second sides are joined by three acute-angle corners and three obtuse-angle corners alternatingly spaced around the drive projection.

10. The toner drum drive assembly of claim 9, wherein the drive projection includes chamfers between adjacent first and second sides, wherein the chamfers are formed along a portion of each acute-angle corner and define the undercuts.

11. A toner drum drive assembly comprising:

a support portion defining an axis; and a drive projection extending axially from the support portion, the drive projection including three radially outwardly and circumferentially curved arm portions arranged in a generally pinwheel-like shape, each arm portion having an end, and the drive projection defining three undercuts, each undercut positioned axially between the support portion and a respective arm portion end, wherein the drive projection includes three convex sidewalls and three concave wall portions, wherein each concave wall portion extends substantially radially outwardly away from the axis and joins a respective substantially flat upright face, wherein each upright face defines the end of a respective one of the arm portions, wherein each upright face extends between its respective concave wall portion and a respective adjacent one of the convex sidewalls, wherein each convex sidewall includes a proximal end proximal to the axis and a distal end distal from the axis, and wherein each concave wall portion is positioned adjacent the proximal end of a respective one of the convex sidewalls.

12. The toner drum drive assembly of claim 11, wherein each concave wall portion provides a geometric transition between a generally circumferentially directed trajectory of the proximal end of its respective convex sidewall and a generally radially outwardly directed trajectory.

* * * * *